US008615979B2

(12) United States Patent
Yenici et al.

(10) Patent No.: US 8,615,979 B2
(45) Date of Patent: Dec. 31, 2013

(54) COTTON DENIM FABRIC WITH A LOW TWIST AND METHOD OF MAKING THEREOF

(75) Inventors: Hamit Yenici, Bursa (TR); Fatih Konukoglu, Bursa (TR); Seref Agzikara, Bursa (TR); Erkan Evran, Bursa (TR); Esref Tuncer, Bursa (TR); Mahmut Ozdemir, Bursa (TR); Tuncay Kilickan, Bursa (TR)

(73) Assignee: Sanko Tekstil Isletmeleri Sanayi Ve Ticaret A.S., Inegol Bursa (TR)

( * ) Notice: Subject to any disclaimer, the term of this patent is extended or adjusted under 35 U.S.C. 154(b) by 0 days.

(21) Appl. No.: 13/252,554

(22) Filed: Oct. 4, 2011

(65) Prior Publication Data

US 2012/0079802 A1 Apr. 5, 2012

Related U.S. Application Data

(60) Provisional application No. 61/389,462, filed on Oct. 4, 2010.

(51) Int. Cl.
*D02G 3/02* (2006.01)

(52) U.S. Cl.
USPC ..... 57/236; 57/237

(58) Field of Classification Search
USPC ..... 57/258, 252–257, 236
See application file for complete search history.

(56) References Cited

U.S. PATENT DOCUMENTS

| | | | | | |
|---|---|---|---|---|---|
| 3,981,836 | A * | 9/1976 | Pangle, Jr. et al. | 524/549 |
| 3,983,271 | A * | 9/1976 | Pangle, Jr. et al. | 427/389.9 |
| 4,428,752 | A * | 1/1984 | Goldenstein | 8/529 |
| 4,853,021 | A * | 8/1989 | Soszka et al. | 65/438 |
| 4,927,445 | A * | 5/1990 | Soszka et al. | 65/504 |
| 5,330,538 | A * | 7/1994 | Teague et al. | 8/114.6 |
| 5,396,688 | A * | 3/1995 | Brown et al. | 26/28 |
| 5,419,952 | A * | 5/1995 | Brown et al. | 442/187 |
| 6,065,277 | A * | 5/2000 | Foil, Jr. | 57/2 |
| 6,354,067 | B2 * | 3/2002 | Foil, Jr. | 57/1 R |
| 6,477,826 | B2 * | 11/2002 | Driggars | 57/256 |
| 6,694,720 | B2 * | 2/2004 | Driggars et al. | 57/408 |
| 7,185,405 | B2 * | 3/2007 | Rastogi et al. | 28/190 |
| 2002/0129596 | A1 * | 9/2002 | Driggars | 57/408 |
| 2003/0115851 | A1 * | 6/2003 | Driggars et al. | 57/408 |
| 2003/0136099 | A1 * | 7/2003 | Hietpas et al. | 57/75 |
| 2007/0067918 | A1 * | 3/2007 | Agnihotri | 8/115.51 |

OTHER PUBLICATIONS

Kathryn L. Hatch, Textile Science, 1993, West Publishing Company, 1st Edition, pp. 291, 292.*

* cited by examiner

*Primary Examiner* — Shaun R Hurley
(74) *Attorney, Agent, or Firm* — Sughrue Mion, PLLC

(57) ABSTRACT

A cotton denim fabrics and method of making denim fabrics that are soft, smooth, bright and include a low twist multiple, a sizing at the surface of the yarn with a viscosity such that the sizing remains substantially at the surface of the yarn, and a dyed cored wherein an indigo dye penetrates deeply into the core.

10 Claims, 6 Drawing Sheets

CARDED SYSTEM

COMBED SYSTEM

WITH HALF MOON DISK HEIGHT PIECE

WITHOUT HALF MOON DISK HEIGHT PIECE

COTTON DENIM FABRIC WITH A LOW TWIST AND METHOD OF MAKING THEREOF

BACKGROUND

1. Field of Invention

Articles and methods consistent with the present invention are related to yarns for woven fabrics, and woven fabrics, specifically cotton and non-cotton denim.

2. Background

Woven fabrics can be created from a wide variety of yarns. The choice of fiber determines the qualities and characteristics of the fabric. Accordingly, different fibers are chosen for different types of fabrics.

Fibers can be characterized into the following general categories:

- Natural fibers—these fibers are produced from naturally occurring materials, and include yarns such as cotton, wool, linen, silk, cashmere, and others known to those skilled in the art.
- Regenerated fibers—these fibers are produced from naturally occurring materials, but require further chemical reprocessing to be manufactured into filaments or fibers suitable for making into yarns. Regenerated fibers include viscose, rayon, tencel, modal, and other fibers known to those skilled in the art.
- Manmade or synthetic fibers—These fibers are generally produced from petroleum-based chemicals, and include polyester, nylon, acrylic and others known to those skilled in the art.

Throughout history, all kinds of plants, roots, animal hairs and other naturally occurring products have been used to create natural fibers. The popularity of each material is often determined by the availability of the raw materials, or the relative difficulty of converting the raw materials into yarns suitable for the creation of textiles. The most common natural fibers are cotton, wool, linen and silk, with each fiber exhibiting different desirable qualities, as well as drawbacks.

Silk is very fine, smooth and soft, and can exhibit very bright colors. On the other hand, silk is very difficult to acquire and is also quite expensive to produce. Wool is a very good insulator, is durable, and makes a wonderful fiber for suits. Unfortunately, consistently acquiring wool of equal quality can be difficult, and it can be relatively expensive. Linen is very dry and is very good at keeping the body cool in hot climates, but it is hard to produce, and finding yarns of consistent quality can be difficult. Cotton is the most widely available natural fiber, and therefore, it is used in all kinds of textile products; from underwear to socks, trousers to jackets, and casual clothing to formal clothing. Cotton is also the most reasonably priced fiber in the world. Cotton has a familiar and desirable feel. Cotton fibers also tend to be the easiest natural fiber to produce.

Throughout the years, a wide range of machinery has been developed to aid in the formation of yarns and fabrics made from these natural fibers, with unique equipment being developed for each type of fiber. For example, the machinery used to create wool fibers and fabrics cannot be used for cotton, linen or silk, and vice versa.

Regenerated and synthetic fibers are often developed to mimic the qualities and characteristics of natural fibers while using other source materials such as wood, leaves, linters and petroleum-based chemicals. For example, viscose and rayon were developed to compete with cotton; nylon was developed to compete with wool; and polyester was developed to compete with silk. While theses regenerated and synthetic fibers can be created such that some of their properties surpass those of natural fibers, they often come with specific drawbacks. For example, regenerated and synthetic fibers often exhibit strength superior to that of the natural fibers, but also have an unpleasant feeling on the skin. While regenerated and manmade fibers have become successful and have found a place in textile industry, the search continues for regenerated and synthetic fibers that look and perform like natural fibers without any accompanying drawbacks.

Denim fabric is currently one of, if not the most, popular fabrics in the world. Denim can be found everywhere, denim can be worn by everyone, denim is strong, denim is casual, denim is sporty, denim can be formal, denim can be worn during the week and weekend, day and night.

Accordingly, there is a great amount of interest in creating denim fabrics using fibers other than cotton to produce denim which exhibit the desirable qualities of these fibers. For example, denim has been produced from silk, rayon and tencel fibers. Silk denim, for example, can result in a bright shiny fabric that is very soft to the touch, and exhibits a very luxurious look. Unfortunately, these silk denims are very expensive and cannot be produced in large quantities due to the low availability of silk. Silk denims also do not take well to finishing processes such as scraping or stone washing. Silk, viscose, rayon and tencel fibers require special laundering treatments which raise the cost of producing the denim. Similarly, wool denims can be very expensive to produce, and are not good for hot climates.

Accordingly, the production of yarns and textiles that exhibit the desirable properties of silk without the accompanying expense would be very beneficial. In particular, if such yarns and fabrics could be produce from a widely available fiber like cotton, it would be even more desirable. Finally, if such yarns and fibers could be produced using the machines and techniques currently available for cotton fibers it would be even more desirable.

SUMMARY

Exemplary embodiments provide a fabric that is soft to the touch, has a smooth surface, and has bright colors, without encountering any of the difficulties associated with denims made from silk or rayon fibers. Other exemplary embodiments of the invention provides a method of making such an article.

In accordance with exemplary embodiments, described herein is a fabric having spun-in, combed, ring spun cotton warp and/or weft yarns with a twist multiple different from twist multiples of traditional cotton warp and/or weft yarns. Exemplary embodiments also encompass methods of producing these warp and/or weft yarns.

Exemplary embodiments provide a low twist, combed, indigo yarn comprising a twist multiple between 2.0 and 3.4, inclusive; a sizing at the surface of the yarn, and a dyed core; wherein an indigo dye penetrates deeply into the core; wherein a viscosity of the sizing during application is between 18 and 30 sec, inclusive; and the sizing remains substantially at the surface of the yarn.

Exemplary embodiments further provide a method of producing an indigo yarn, the method comprising providing combed cotton fibers; spinning the cotton fibers to produce yarns having a twist multiple between 2.0 and 3.4, inclusive; dying the yarns, wherein a dye penetrates deeply into the core; sizing the yarns using a sizing with a viscosity between 18 seconds and 24 seconds, inclusive; squeezing the yarns after sizing at a pressure between 15 KN and 21 KN, inclusive.

Exemplary embodiments further provide a method of producing a denim fabric from the yarns, comprising weaving a fabric, wherein the weaving comprises feeding the warp yarns in a loom through a front roller and a back roller; wherein the warps yarns are under less tension when a shed is open, and wherein an angle between the front roller and the back roller is between 1.8 and 2.8 degrees, inclusive.

DETAILED EXPLANATION

Figure 1:
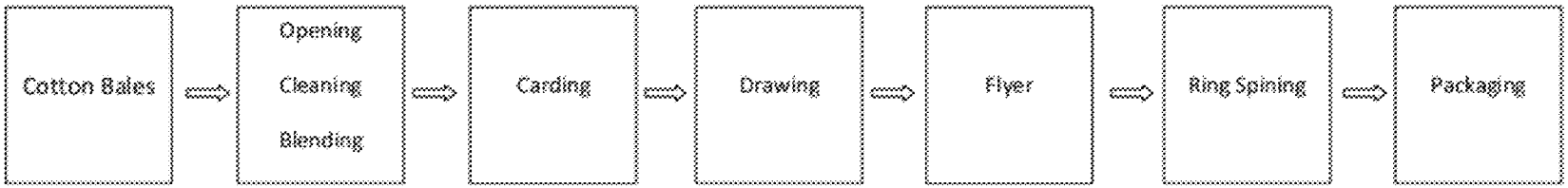
FIG. 1—A process for producing cotton yarns according to an exemplary embodiment.
Figure 1:
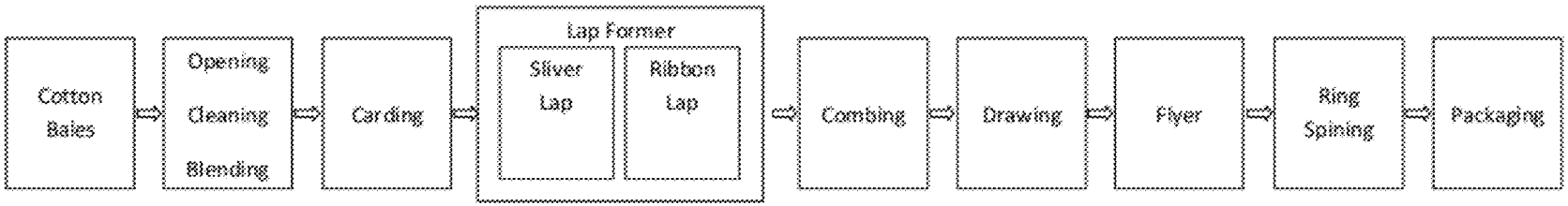
Figure 2:
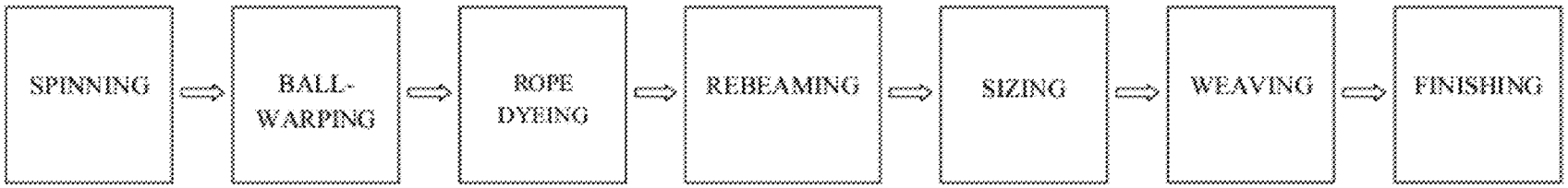
FIG. 2—A process for producing denim according to an exemplary embodiment.

The process of creating the yarns according to an exemplary embodiment will now be described. There are many different yarn spinning technologies (ring, open-end, ring-can, vortex etc) in cotton spinning In exemplary embodiments of the present application, a ring spinning technology is used Raw Material Cotton Processing In a ring spinning system, the processing of the raw cotton can be begin in one of two ways: combing or carding. While the process is similar for both, combing requires additional steps. All the steps of both processes can be seen in FIG. 1. In the carding process, usually any kind of cotton fibers can be used. The length of the fibers can be relatively shorter than those of fibers used in a combed system. Though, using fibers of comparable length thickness is generally preferable for the quality of the finished yarn.

In the combed process, the cotton fibers lengths are chosen to be a little longer than the fibers in the carded system, and the process results in fiber lengths that are very similar in length to each other. Thin, low micronare fibers are also chosen. By selecting fibers with these qualities, a better quality yarn can be achieved.

Blending, Opening and Cleaning

In combed and carded systems, 20-60 bales of cotton are put behind the opening of the opening, cleaning and blending unit. Some fibers from of each of the cotton bales are sent to the opening, cleaning and blending unit. In the unit, cotton pieces are opened to form fibers, and dirt and extremely short fibers are removed.

In a combed system, in order to have cleaner fibers, the opening, cleaning and blending unit is adjusted to be more sensitive, thereby removing more of the short fibers.

Carding and Combing

In both combed and carded systems, the opened and cleaned cotton fibers are delivered to a carding machine by an air system. The carding machine has two large cylindrical rollers which run together and are surrounded with steel combs. The two rollers spin at different speeds. When the cotton fibers pass between the steel combs, the cotton fibers are arranged parallel to each other. The distance between the rollers and the difference in their speeds determines the percentage of short fibers that are discarded during the carding. In a combed system, like that of exemplary embodiments, the carding machine is set to discard a greater percentage of short fibers. At the end of the process, the carded cotton fibers are loose untwisted ropes of cotton fibers known as card slivers.

The next three steps are only performed in a combed system, including the process of exemplary embodiments.

Sliver Lap: This is the first step of combing. Usually 24 card slivers are brought together to form a sliver lap, which gives a much wider surface for the combing process.

Ribbon Lap: In this second step, eight of the sliver laps are combined.

Combing: This step is the main difference between carding and combing. In this step, all of the fibers are intensely combed, eliminating 15-20% of the short fibers. After the combing, the cotton fibers are substantially the same length and substantially parallel. Having fibers of the same length is important for making a strong, "less-hairy" yarn.

In some newer systems, the sliver and ribbon lap systems can be combined into a single "lap former" step, which combines 24 slivers in preparation of combing.

After combing, both carded and combed systems follow the same steps.

According to exemplary embodiments, a combed system is used in order to make all the fibers as parallel as possible. Certain exemplary embodiments make use of extra long staple cotton fibers such as pima, supima or Egyptian cotton have been used. Other exemplary embodiments use regular cotton blends such as those used in non-inventive denim production.

Drawing

During drawing, 8-16 slivers are drawn together to create a well-blended mixture of fibers. The ends of all cotton fibers naturally possess a structure similar to that of a small hook. During drawing, these hooks are opened resulting in a better quality yarn. The drawing process is generally repeated more than once.

Flyer Process

Figure 3:
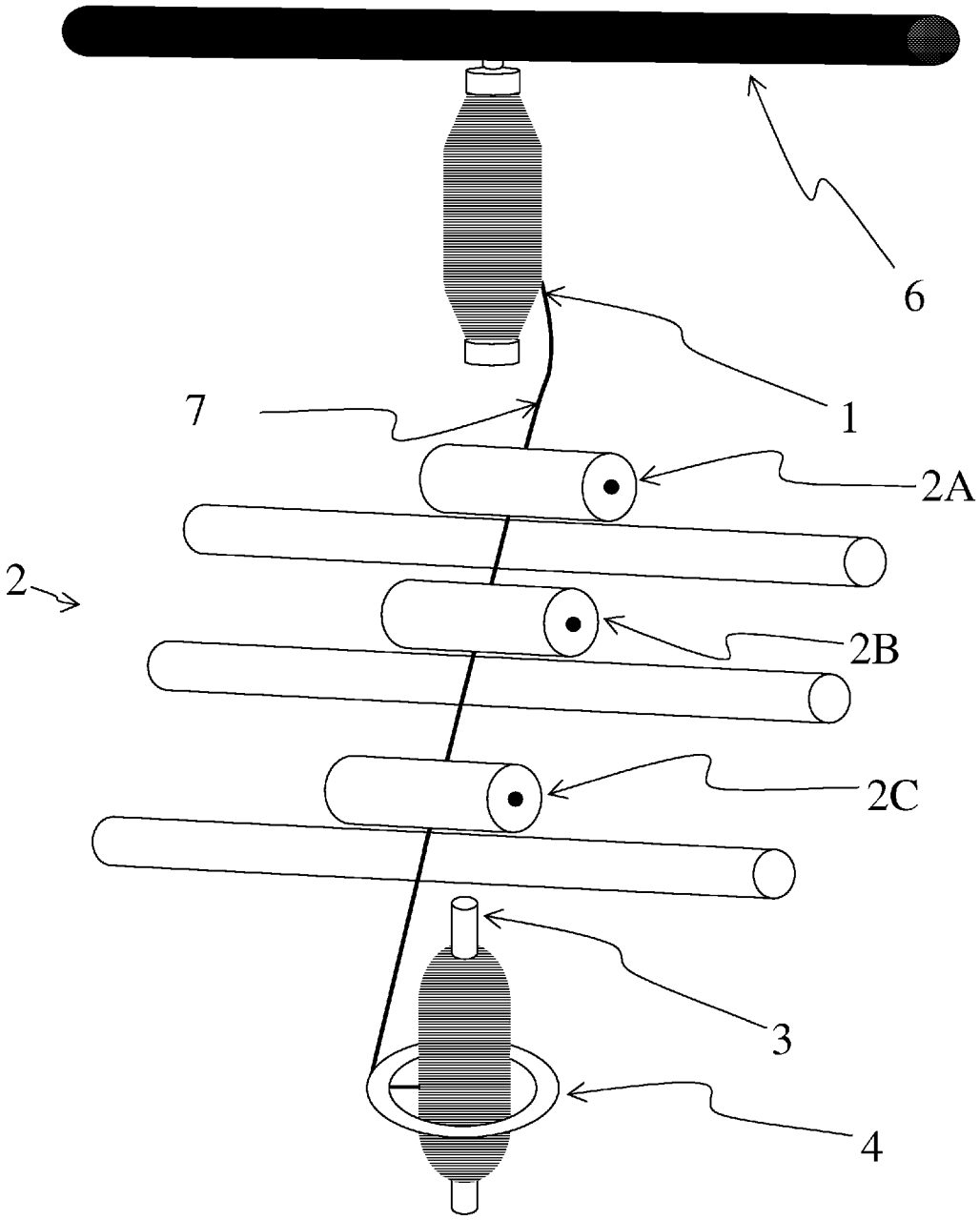
FIG. 3—A schematic drawing of a yarn spinning device according to an exemplary embodiment.

In order to spin the yarn the slivers need to be thinner. The slivers are delivered to flyer machines which reduce the thickness of the slivers to roving form by applying a slight twist to the slivers. This slight twist helps to hold the fibers together. The slight twisted slivers are known as rovings Ring Spinning Once the flyer process is complete, the rovings are ready to be spun. Roving spools 1 are mounted in a ring frame 6 so that the fibers can be spun. An apparatus for spinning fibers according to exemplary embodiments is depicted in FIG. 3. The fibers 7 from the roving 1 are delivered to a drafting section 2 comprising roller groups 2A-C. Each of the three roller groups is run at a different speed. The first roller group 2A is the slowest of the three, so as the fibers 7 move from the first roller group 2A to the faster second roller group 2B, the delivered fibers 7 are thinned. The third and fastest roller group 2C further thins the groups of fibers 7. At this point there is no twist to the fibers 7.

From the third roller group 2C, the fibers 7 are sent to a traveler 4 and a spindle 3. Here, the difference in speed of the traveler 4 and spindle 3 create a twist in the fibers 7. The faster the spindle 3 rotates relative to the yarn delivery speed, the higher the twist in the yarn.

During the spinning, two parameters for the yarn are set.

Yarn Count—The thickness of the yarn is given by a value known as the yarn count. For cotton yarns, the yarn count is normally given in English cotton number (Ne). A smaller English cotton number signifies a thicker, coarser yarn, while a larger English cotton number signifies a thinner, finer yarn. For example, Ne 6 is signifies a yarn thicker than Ne 20. The English cotton number can also be given by two numbers, one representing the thickness, and the second representing if the final yarn is a combination of two precursor yarns. For example, Ne 6/1 signifies a single Ne 6 count yarn. Ne 20/2 signifies a two-ply yarn created by twisting two Ne 20 count yarns together.

Twist Multiple—The amount of twist in a yarn can determine its properties, such as strength and softness. To be able to compare the qualities of yarns having different thickness, a twist multiple value is used. Twist multiple is a pure number that allows for yarns of different constructions to be easily compared. Specifically, the holding power of two yarns of different constructions can be compared. For example, an Ne 6 yarn with 10.28 twists/inch and a Ne 20 yarn with 18.78 twist/inch will have the same holding power as they both have a twist multiple of 4.2. The twist multiple is calculated as follows.

$$\text{Twist/inch} = \text{Twist Multiple} \times \sqrt{\text{EnglishCottonNumber}}$$

Solving for twist multiple gives:

$$\text{Twist Multiple} = \frac{\text{Twist/inch}}{\sqrt{\text{English Cotton Number}}}$$

Twist/inch can be determined from the following formula:

$$\text{Twist/inch} = \text{Spindle RPM/Yarn Delivery Speed}$$

Accordingly, by using these formulas, the spinning machine can be set to deliver a yarn with a specific twist multiple.

When converting the yarns into fabrics through knitting or weaving, the yarns have to have a minimum twist multiple because the yarns have to be strong enough to be knit or woven with good efficiency. Due to different production steps and machinery, the twist multiple for weaving yarns needs to be higher than the twist multiple for yarns for knitted fabrics. In particular, weaving warp yarns, which are maintained at higher tension, need to be stronger than the yarns used in knitting.

For denim weaving, the cotton yarns generally have warps yarns with a twist multiple between 3.8-5.2. Below this range, the yarns are not strong enough to be woven efficiently, and breaks in the yarn become common. In knitting, a twist multiple of 3.5-4.0 is usually sufficient.

A higher twist number results in some less than desirable qualities in the fabric. As the twist multiple increases, the yarn becomes less brilliant because the additional twists reflect the light differently than yarns with a lower twist. On the other hand, a lower twist multiple can result in a brighter fabric. Additionally, as the twist multiple increases, the yarns become stiffer, resulting in a rougher fabric. As the twist multiple decreases, the fabric becomes softer.

According to exemplary embodiments, yarns of an extremely low twist level are used to create a soft, brilliant, silk-like denim fabric. For example, twist multiples between 2.0 and 3.4 a preferably used. It is even more preferred that the twist multiple be between 2.6 and 3.3, and even more preferable that the twist multiple be between 3.0 and 3.2. This low level twist results in a very soft fabric with fantastic light reflection that is brilliant in color.

To be able to create such a low twist multiple, certain adjustments need to be made to the spinning process. In exemplary embodiments, the spindle speed is reduced from 10500-20000 rpm to 8000-17000 rpm. This spindle speed is given for a Rieter spinning machine, but a person of ordinary skill in the art would understand that these values may be different for different spinning machines.

When the twist multiple decreases, the yarn diameter can increase and the fibers may not hold together as well, and may become hairier. To avoid this problem, the weight of the travelers have been reduced.

Figure 4:
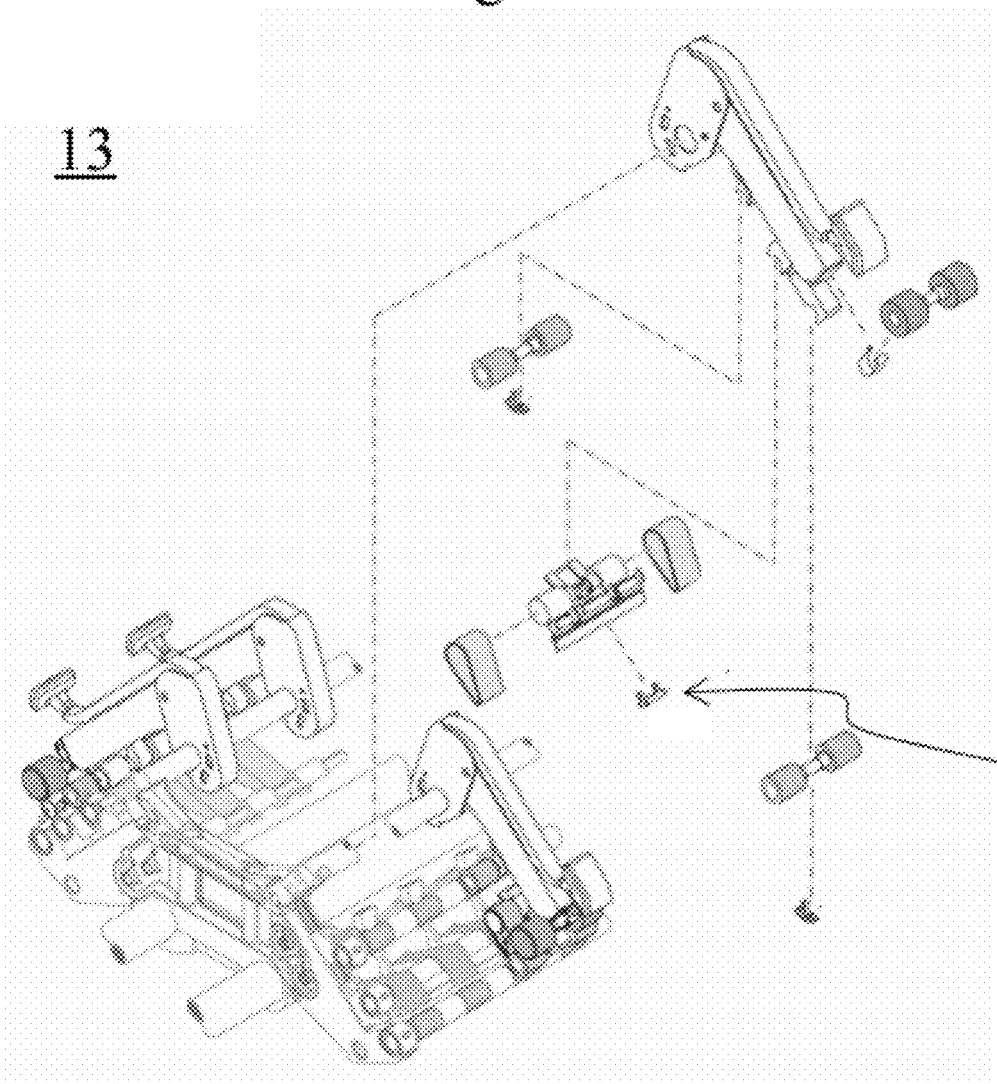
FIG. 4—A schematic drawing of a spinning frame according to an exemplary embodiment.

In ring spinning frames (See weaving frame 13, FIG. 4), there are systems that create pressure on top of the draft rollers The amount of pressure is set by plastic pieces called clips (See clips 8 in FIG. 4). When taller plastic clips are used there is less tension on the fibers during drafting, and when shorter clips are used, more tension is given to the fibers during the drafting. In exemplary embodiments, larger than normal clips are used. Exemplary differences for the heights of the clips can be found in the examples provided.

Packaging

During packaging, twist yarn spools are packaged together into large weaving packages. Packaging also includes quality control in the form of yarn detectors which can observe faults in the yarn, and can cut and remove theses faults during the packaging process.

As shown below in table 1, when the twist level is lowered, the yarn diameter increases. All the spun yarns need to be wound to spools and these spools must be spliced, cleaned, and wound into weaving packages. Due to the increased yarn diameter, the packaging machine is set like a machine running thicker yarn sizes. A comparison of yarn sizes of additional exemplary embodiments conventional yarn sizes can be found in the Table 1-1.

TABLE 1

| Related Art | | | Exemplary Embodiments | | |
|---|---|---|---|---|---|
| NE | Twist Multiple | ÇAP 2DQ MM | NE | Twist multiple | ÇAP 2DQ MM |
| 7.4/1 | 4.2 | 0.453 | 7.4/1 | 3 | 0.512 |
| 10/1 | 4.2 | 0.391 | 10/1 | 3.0 | 0.426 |
| 20/1 | 4.2 | 0.268 | 20/1 | 3.0 | 0.303 |
| 30/1 | 4.2 | 0.228 | 30/1 | 3.0 | 0.247 |

Ball Warping, Rope Dyeing and Rebeaming

Figure 6:
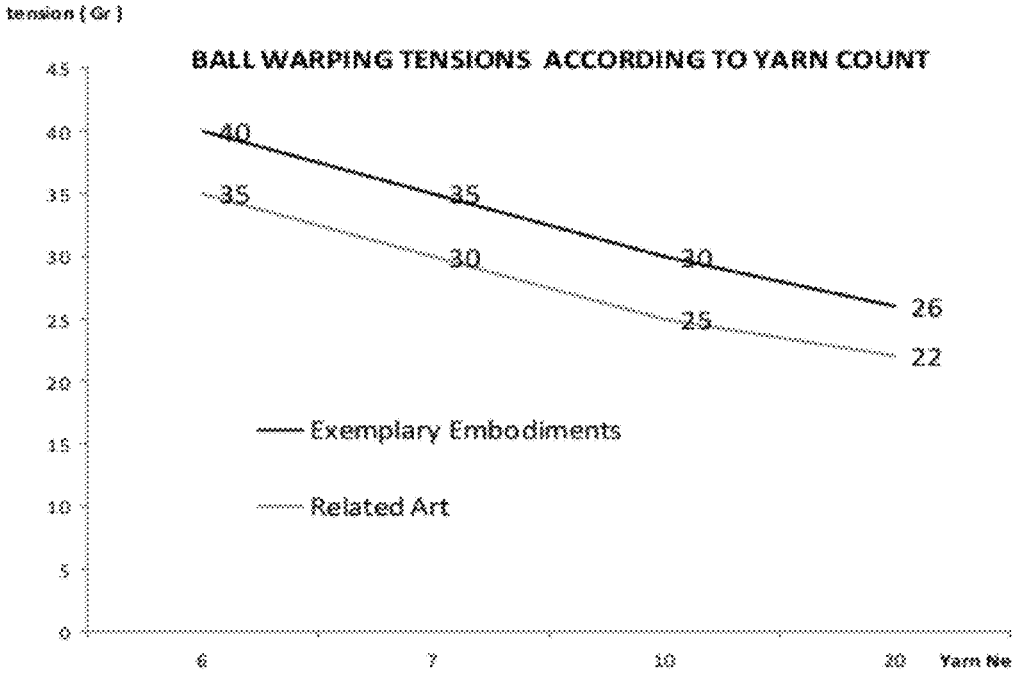
FIG. 6—A graph comparing string tension in a normal ball warping process compared to the process of exemplary embodiments.

According to exemplary embodiments, the tension in the yarns during ball warping is changed from those of conventional yarns. For example, depending on the tension of the yarns during ball warping may be increased over related art processes. In exemplary embodiments, and as depicted in FIG. 6, the tensions during ball warping can be increased between 10 and 30%, with increases of 15-20% being more preferable.

Figure 7:
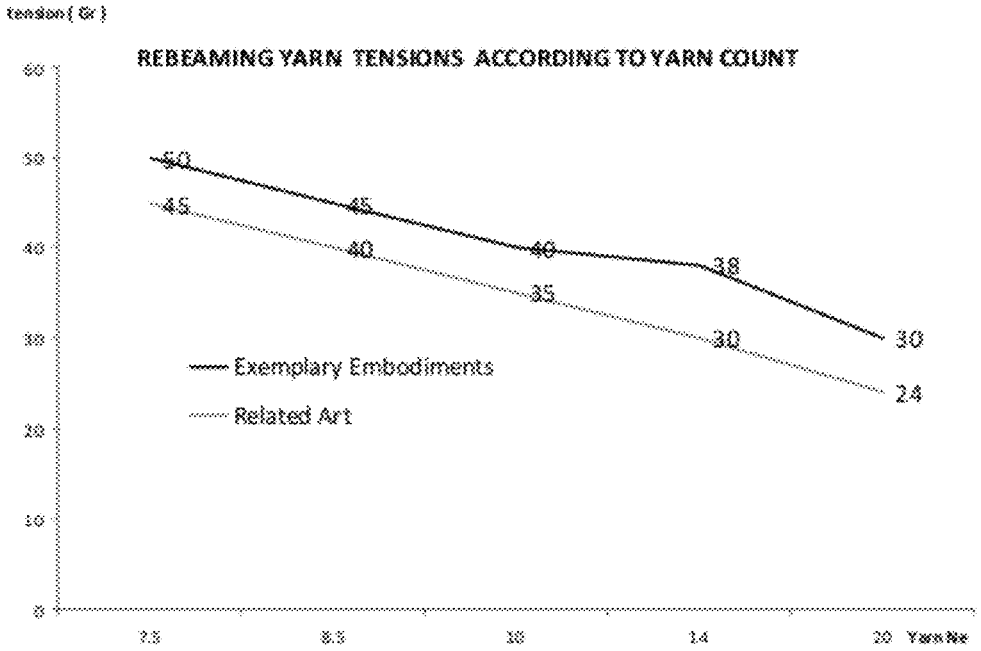
FIG. 7—A graph comparing string tension in a normal rebeaming process compared to the process of exemplary embodiments.

Similar to ball warping, according to exemplary embodiments, the tension in the yarns during rope dying and rebeaming may also be changed when compared to those of related art processes. For example, and as depicted in FIG. 7, the tension in the yarns during rebeaming and rope dying may be increased between 5 and 30%, with increases of 10-25% being more preferable.

Dyeing

When the fabric of exemplary embodiments is dyed with indigo, the indigo dye penetrates into the yarns more deeply due to the decreased twist level, giving it a look that is much different from that of normal dyed denim.

Sizing

Due to the low twist on the yarn, size chemicals more easily penetrate to the inside of the yarn, resulting in a stronger, but more brittle and easily broken yarn. Accordingly, exemplary embodiments employ new sizing techniques to improve the performance of the yarns during weaving.

A significant amount of sizing chemicals must be added to strengthen the yarn, but at same time the sizing chemicals must be kept on the outside of the yarn and not penetrate to the inside. This allows for an increased strength yarn, while keeping the yarn flexible.

To achieve these qualities, a new sizing chemical formulas are used with increased viscosity. Exemplary embodiments of the new sizing can be found in the specific examples set forth below. The increased viscosity keeps the sizing at the surface of the yarn, and keeps it from penetrating inside the yarn. It is preferred that the viscosity be increased by as much as 10-50% over traditional sizing, it is more preferred that it be increased 25-40%, and even more preferred that it be increased 20-30%. For example, in exemplary embodiments, the viscosity is increased from 14-22 second, to 18-24 seconds, depending on the size and qualities of the yarn, as would be understood by a person of ordinary skill in the art.

Normally, after being dipped in the sizing chemicals, the yarns are squeezed by rollers to remove excess sizing chemicals. Under the normal process, the squeezing causes some of the chemical to penetrate further into the yarn, a process that would be increased due to the decreased twist in yarns of exemplary embodiments. According to exemplary embodiments, the squeezing pressure is decreased, preferably by as much as 30%, more preferably by 20%, and even more preferably by 15%. Preferably, the squeezing is done at a pressure between 15 KN and 21 KN. This decrease helps keep the size chemical at the surface of the yarn.

By making these changes, the amount of sizing chemicals imparted to the yarn has increased by 1%, and the yarns may experience increases in strength of 30%, 40% or even 50%. Comparatively, related art processes result in an approximately 25% increase in strength.

Weaving

When weaving, the yarns, particularly the warp yarns, must be kept at a certain tension, the level of which often depends on the desired fabric. Heavy or tight fabrics are more difficult to weave and need more tension. When the twist level is reduced, controlling the weaving tension becomes more important. Because the lower twist level reduces the strength of a yarn, the weaving tension must sometimes be reduced. But, if the tension is reduced too much, it becomes difficult or impossible to successfully weave the fabric.

For the yarns of exemplary embodiments, the tension during weaving can be controlled in a different way. In a weaving machine, schematically depicted in FIG. 5, there are two important sets of rollers, the back rollers made up of a back rest roller 9 and a guiding roller 10 positioned just on top of the warp yarns beam over which the warp yarns roll, and a front roller comprised of a cloth take-up support plate 12 positioned at the front to hold the woven fabric over which the woven denim 15 rolls. There is normally a 3 degree angle between the back and front rollers, with the back rollers raised above the front roller by a half moon disc height piece 11. This angle creates a higher tension when the shed is lowered, and decreased tension when the shed is raised. According to exemplary embodiments, a new arrangement has been created to decrease tension when the shed is open, but maintain sufficient overall tension to allow efficient weaving.

Figure 5:
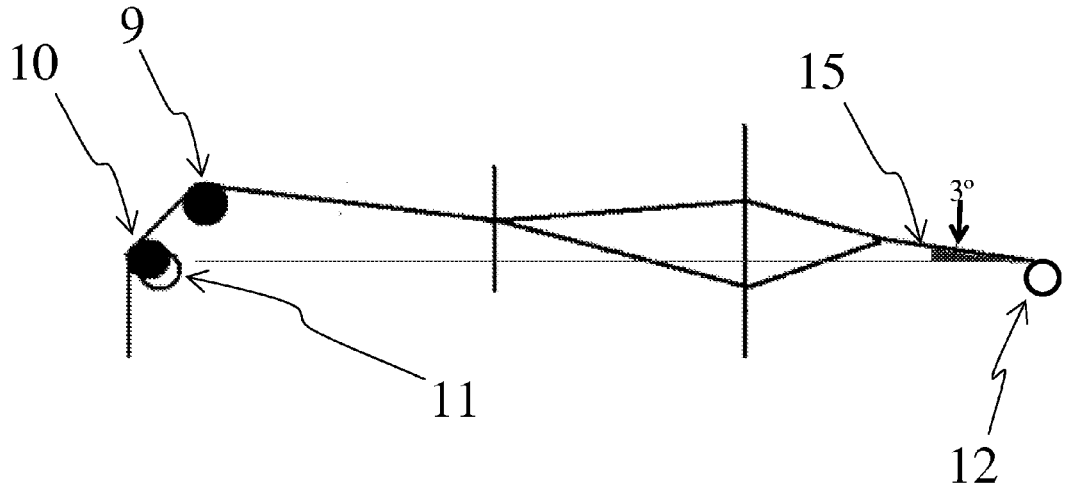
FIG. 5—A schematic drawing of a weaving machines according to exemplary embodiments.
Figure 5:
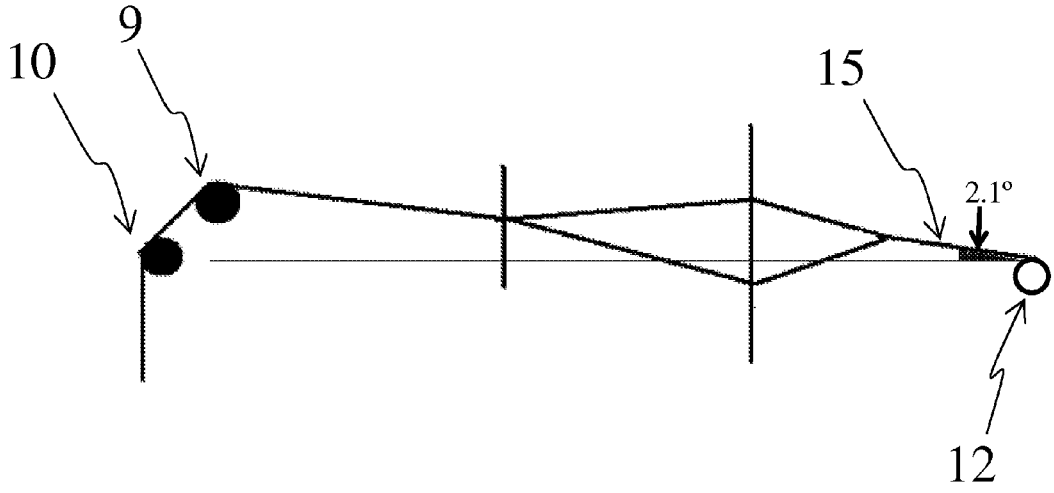

In exemplary embodiments the angle between the front and back rollers has been decreased from 3 degrees to an angle between preferably 1.8 and 2.8, more preferably between 2.0 and 2.6 degrees, and even more preferably between 2.1 and 2.5 degrees. A schematic representation of the difference in angle is depicted in FIG. 5.

What follows next are very specific example of exemplary embodiments according to the inventive concept compared with related art examples. The inventive concept is capable of other and different embodiments without deviating from the scope and spirit of the inventive concept. The examples should be considered illustrative in nature and not as restrictive.

EXAMPLE 1

The exemplary example out lined in Table 2 below compares an exemplary embodiment utilizing a 20/1 Ne cotton yarn with a related art process using a cotton yarn with the same 20/1 Ne.

TABLE 2

| | Example 1 | Related Art |
|---|---|---|
| YARN/FIBER COMPARISON | | |
| YARN COUNT (Ne) | 20/1 | 20/1 |
| YARN CODE | SPPF07 | K017 |
| SPINDLE SPEED (rpm) | 12000 | 14000 |
| CLIPS (mm) | 3.5 | 3 |
| TWIST MULTIPLE | 3 | 4.35 |
| TWIST PER METER | 528 | 766 |
| HAIRNESS | 6.8 | 7.2 |
| DIAMETER 2D (mm) | 0.305 | 0.295 |
| STRENGTH cN/tex | 25.51 | 17.87 |
| ELONGATION (%) | 5.3 | 5 |
| MICRONAIRE RANGE (mic) | 3.3-4.2 | 3.8-5.0 |
| FIBER LENGTH RANGE (mm) | 35-38 | 28-30 |
| BLOWROOM AND CARDING WASTE (%) | 4.9 | 10.1 |
| COMBING WASTE (%) | 14.17 | — |
| TOTAL WASTE (%) | 19.07 | 10.1 |
| WARPING COMPARISON | | |
| BALLWARPING TENSION | 30 | 25 |
| REBEAMING TENSION | 30 | 24 |
| INDIGO PENETRATION | DEEP | SHALLOW TO INTERMEDIATE |
| VISCOSITY OF SIZING (sec) | 27.62 | 21.13 |
| PRESSURE OF SQUEEZING ROLLER (KN) | 17 | 20 |
| SIZING FORMULA | 69 kg. SOLAMYL 9636 (AGRANA)<br>18 kg. SİZE CO (BASF)<br>3 kg. ARKOFİL CMC20 (CLARIANT)<br>7 kg. ARKOFİL CMC300 (CLARIANT)<br>10 kg. POVAL JP 18Y (JAPAN VAM & POVAL CO. LTD)<br>2 kg. GLİSOFİL EXTRA (AVEBE) | 63 kg. SOLAMYL 9636 (AGRANA)<br>18 kg. SİZE CO (BASF)<br>3 kg. ARKOFİL CMC20 (CLARIANT)<br>4 kg. ARKOFİL CMC300 (CLARIANT)<br>10 kg. POVAL JP 18Y |

TABLE 2-continued

| | Example 1 | Related Art |
|---|---|---|
| | | (JAPAN VAM & POVAL CO. LTD) 2 kg. GLİSOFİL EXTRA (AVEBE) |
| SIZE ADD-ON (%) | 11.07 | 9.84 |
| WEAVING COMPARISON | | |
| SHED ANGLE | 2.1 | 3 |

EXAMPLE 2

The exemplary example out lined in Table 3 below compares an exemplary embodiment utilizing a 14/1 Ne cotton yarn with a related art process using a cotton yarn with the same 14/1 Ne.

TABLE 3

| | Example 2 | Related Art |
|---|---|---|
| YARN/FIBER COMPARISON | | |
| YARN COUNT (Ne) | 14/1 | 14/1 |
| YARN CODE | PP004 | K014 |
| SPINDLE SPEED (rpm) | 10000 | 13600 |
| CLIPS (mm) | 5 | 3.3 |
| TWIST MULTIPLE | 3 | 4.2 |
| TWIST PER METER | 471 | 619 |
| HAIRNESS | 9.4 | 3 |
| DIAMETER 2D (mm) | 0.375 | 0.355 |
| STRENGTH cN/tex | 15.53 | 17.85 |
| ELONGATION (%) | 5.1 | 5.5 |
| MICRONAIRE RANGE (mic) | 3.8-5.0 | 3.8-5.0 |
| FIBER LENGTH RANGE (mm) | 28 - 30 | 28 - 30 |
| BLOWROOM AND CARDING WASTE (%) | 10.1 | 10.1 |
| COMBING WASTE (%) | 14.75 | — |
| TOTAL WASTE (%) | 24.85 | 10.1 |
| WARPING COMPARISON | | |
| BALLWARPING TENSION | 30 | 25 |
| REBEAMING TENSION | 38 | 30 |
| INDIGO PENETRATION | DEEP | SHALLOW TO INTERMEDIATE |
| VISCOSITY OF SIZING (sec) | 23.94 | 18.27 |
| PRESSURE OF SQUEEZING ROLLER (KN) | 17 | 20 |
| SIZING FORMULA | 80 kg. EMSİZE E5 (EMSLAND GROUP) 6 kg. ARKOFİL CMC20 (CLARIANT) 3 kg. ARKOFİL CMC300 (CLARIANT) 3 kg. J-POVAL JP 18Y (JAPAN VAM & POVAL CO. LTD) 2 kg. GLİSOFİL EXTRA (AVEBE) | 80 kg. EMSİZE E5 (EMSLAND GROUP) 12 kg SİZE CO (BASF) 3 kg. POVAL JP 18Y (JAPAN VAM & POVAL CO. LTD) 2 kg. GLİSOFİL EXTRA (AVEBE) |
| SIZE ADD-ON (%) | 13.14 | 12.41 |
| WEAVING COMPARISON | | |
| SHED ANGLE | 2.1 | 3 |

EXAMPLE 3

The exemplary example out lined in Table 4 below compares an exemplary embodiment in which two cotton yarns are spun together compared with a related art process using two cotton yarns similar to those used in the exemplary embodiment.

TABLE 4

| | Example 3 | | Related Art | |
|---|---|---|---|---|
| YARN/FIBER COMPARISON | | | | |
| YARN COUNT | 7.5/1 | 10/1 | 7.25/1 | 9.78/1 |
| YARN CODE | SPPF05 | SPPF03 | F150 | F637 |
| SPINDLE SPEED (rpm) | 7500 | 8200 | 10400 | 12000 |
| CLIPS (mm) | 5.5 | 5 | 5.5 | 4.4 |
| TWIST MULTIPLE | 3 | 3 | 4.3 | 4.4 |
| T/M | 323 | 373 | 456 | 542 |
| HAIRNESS | 10.3 | 9.2 | 10.0 | 9.2 |
| DIAMETER 2D (mm) | 0.495 | 0.425 | 0.485 | 0.42 |
| STRENGTH cN/tex | 25.11 | 26.35 | 17.2 | 17.0 |
| ELONGATION (%) | 6 | 6.2 | 6.6 | 6.1 |
| MICRONAIRE RANGE (mic) | 3.3-4.2 | 3.3-4.2 | 3.8-5.0 | 3.8-5.0 |
| FIBER LENGTH RANGE (mm) | 35-38 | 35-38 | 28-30 | 28-30 |
| BLOWROOM AND CARDING WASTE (%) | 4.9 | 4.9 | 12.9 | 12.9 |
| COMBING WASTE (%) | 14.17 | 14.17 | — | — |
| TOTAL WASTE (%) | 19.07 | 19.07 | 12.9 | 12.9 |
| WARPING COMPARISON | | | | |
| BALLWARPING TENSION | 35 | 30 | 30 | 25 |
| REBEAMING TENSION | 50 | 40 | 45 | 35 |
| INDIGO PENETRATION | DEEP | | SHALLOW TO INTERMEDIATE | |
| VISCOSITY OF SIZING (sec) | 18.95 | | 15.47 | |
| PRESSURE OF SQUEEZING ROLLER (KN) | 17 | | 20 | |
| SIZING FORMULA | 70 kg. EMSİZE E5 (EMSLAND GROUP) 4 kg. ARKOFİL CMC20 (CLARIANT) 3 kg. ARKOFİL CMC300 (CLARIANT) 3 kg. J-POVAL JP 18Y (JAPAN VAM & POVAL CO. LTD) 2 kg. GLİSOFİL EXTRA (AVEBE) | | 70 kg. EMSİZE E5 (EMSLAND GROUP) 12 kg. SİZE CO (BASF) 2 kg. GLİSOFİL EXTRA (AVEBE) | |
| SIZE ADD-ON (%) | 9.56 | | 8.61 | |
| WEAVING COMPARISON | | | | |
| SHED ANGLE | 2.1 | 3 | 2.1 | 3 |

What is claimed is:

1. A low twist, combed, indigo yarn wherein the yarn is a two-ply yarn, comprising:

a first yarn and a second yarn, wherein:

the first yarn comprises a first yarn count of 7.5/1 Ne; and the second yarn comprises a second yarn count of 10/1 Ne: and the first yarn and second yarn comprising:

a twist multiple between 2.0 and 3.4, inclusive;

a sizing at the surface of the yarn; and a dyed core wherein an indigo dye penetrates deeply into the core, wherein the sizing remains substantially at the surface of the yarn.

2. A method of producing a low twist, combed indigo yarn, the method comprising:

providing combed cotton fibers spinning the cotton fibers to produce yarns having a twist multiple between 2.0 and 3.4, inclusive;

dying the yarns, wherein an indigo dye penetrates deeply into the core to produce a dyed core;

sizing the yarns using a sizing with a viscosity of sizing chemicals that is such as to keep the sizing substantially at the surface of the yarn; and squeezing the yarns after sizing at a pressure between 15 KN and 21 KN, inclusive to keep the sizing chemicals at the surface of the yarn.

3. The method according to claim 2, wherein the spinning comprises producing a yarn with a yarn count of 20/1 Ne.

4. The method according to claim 2, wherein the spinning comprises producing a yarn with a yarn count of 14/1 Ne.

5. A method of producing a denim fabric from a low twist, combed, indigo yarn, the method comprising:

weaving a denim fabric, wherein the weaving comprises:

feeding the warp yarns in a loom through a front roller and a back roller;

wherein the warps yarns are under less tension when a shed is open, and wherein an angle between the front roller and the back roller is between 1.8 and 2.8 degrees, inclusive, wherein the yarn comprises:

a twist multiple between 2.0 and 3.4, inclusive;

a sizing at the surface of the yarn; and a dyed core wherein an indigo dye penetrates deeply into the core, wherein the sizing remains substantially at the surface of the yarn.

6. The method according to claim 5, wherein the angle between the front roller and the back roller is approximately 2 degrees.

7. A denim fabric comprising a low twist, combed, indigo yarn, said denim comprising:

yarn having a twist multiple between 2.0 and 3.4, inclusive;

a sizing at the surface of the yarn, and dyed yarn having a dyed yarn core wherein an indigo dye penetrates into the yarn core;

and wherein the sizing is kept substantially at the surface of the yarn.

8. The denim fabric comprising a low twist, combed, indigo yarn according to claim 7, wherein the yarn comprises a yarn count of 20/1 Ne.

9. The denim fabric comprising a low twist, combed, indigo yarn according to claim 7, wherein the yarn comprises a yarn count of 14/1 Ne.

10. The denim fabric comprising a low twist, combed, indigo yarn according to claim 7, wherein the yarn is a two-ply yarn, comprising:

a first yarn and a second yarn, wherein:

the first yarn comprises a first yarn count of 7.5/1 Ne; and the second yarn comprises a second yarn count of 10/1 N.

* * * * *